US006393770B1

(12) United States Patent
Groom

(10) Patent No.: US 6,393,770 B1
(45) Date of Patent: May 28, 2002

(54) SCREENING OF GUTTERING

(75) Inventor: Paul Anthony Groom, Olinda (AU)

(73) Assignee: LBI Holdings PTY Ltd., Victoria (AU)

( * ) Notice: Subject to any disclaimer, the term of this patent is extended or adjusted under 35 U.S.C. 154(b) by 0 days.

(21) Appl. No.: 09/711,872

(22) Filed: Nov. 13, 2000

(30) Foreign Application Priority Data

Nov. 11, 1999 (AU) ..... PQ3983

(51) Int. Cl.[7] ..... E04D 13/00
(52) U.S. Cl. ..... 52/12; 210/474
(58) Field of Search ..... 52/11, 12; 210/474

(56) References Cited

U.S. PATENT DOCUMENTS

| | | | | | |
|---|---|---|---|---|---|
| 3,053,393 | A | * | 9/1962 | McLean | 210/474 |
| 4,745,710 | A | * | 5/1988 | Davis | 52/12 |
| 4,765,101 | A | * | 8/1988 | Wolf | 52/12 |
| 5,522,183 | A | * | 6/1996 | Allen | 52/12 |
| 5,555,680 | A | * | 9/1996 | Sweers | 52/12 |

* cited by examiner

*Primary Examiner*—Carl D. Friedman
*Assistant Examiner*—Steve Varner
(74) *Attorney, Agent, or Firm*—Allen, Dyer, Doppelt, Milbrath & Gilchrist, P.A.

(57) ABSTRACT

A screen applied to overlay a guttering (14) on an outside edge of a roof of a building to prevent the entry of unwanted materials such as leaves into the guttering. The screen has a panel (15) of mesh affixed along one of its edges to the roof and along the opposite edge to the top outside edge of the guttering (14). The mesh is formed of moulded plastics material and comprises a top face (38) and a bottom face (40), a first array of longitudinal strands aligned in the direction of the edge of the panel, and a second array of lateral strands, integrally moulded with and aligned at right angles to the first array. The arrays define mesh apertures therebetween extending from said top face to said bottom face. The thickness of the longitudinal strands extends for substantially the full thickness of the mesh while the thickness of the lateral strands extends along their full length, from said top face to less than 80% of the thickness of the mesh. The lateral strands are spaced closer to each other than are the longitudinal strands and the apertures have an oval shape with their longer axis parallel to the lateral strands.

18 Claims, 3 Drawing Sheets

SCREENING OF GUTTERING

FIELD OF THE INVENTION

The present invention relates to the field of devices for preventing clogging of gutters, and, more particularly, to screens for preventing entry of undesired debris into a gutter along the edge of a roof of a house, for example.

BACKGROUND AND SUMMARY OF THE INVENTION

This invention concerns the use of mesh materials as screens over guttering along the edge of the roof of a house, for the purpose of preventing the entry of unwanted materials such as sticks, leaves, and other tree debris, large insects, litter and the like into the guttering. In some places such guttering is called a gutter or spouting, but the general shape remains the same being a gently sloped open topped channel, usually made of metal or plastics material, positioned to collect rainwater as it runs off a roof.

It is well known that the collection of unwanted materials in guttering causes overflowing of the guttering, blockage of the outflow pipes, constitutes a fire hazard and contributes to corrosion of the guttering. It also contaminates any water collected from the roof for drinking or other domestic purposes.

Many systems are in use, and more have been proposed, which provide a screen of mesh to cover the top of the guttering. Some of these systems require the mesh to be tensioned between rigid fastenings on the roof and the top outer edge of the guttering. The mesh in such systems must be kept somewhat tensioned in order for the leaves and sticks to slide over the edge of the gutter. These are the systems to which the present invention is particularly adapted.

Many attempts have been made to produce a mesh system which successfully excludes foreign matter from guttering. Most of these attempts have resulted in a mesh which is so coarse that much material passes through. Although this material is often small enough to be flushed away without blocking downpipes and drains, it can build up in the guttering and can also contaminate water stored in tanks. Perhaps more importantly though is that such mesh is so coarse that sticks and leaf stems easily become caught in it. Trapped in this way, they protrude up from the mesh thus creating a barrier to the escape of other debris and the mesh thus provides a solid anchor for the build-up of further debris around the guttering area on a roof.

Some attempts have been made to use a relatively fine mesh for gutter protection and examples are described in U.S. Pat. No. 5,257,482 and Australian patent publication AU-A-38506/93. But such meshes tend to suffer from the problem of too much restriction to the flow of water through the mesh due to surface tension effects. This means that during anything greater than light rain, water tends to flow in a sheeting characteristic along the top surface of such meshes and on over the outside edge of the guttering instead of passing through the mesh into the guttering. Attempts have been made to reduce this sheeting by providing upwardly extending ridges on the mesh parallel to the gutter edge, but such ridges create a significant resistance to the removal of debris on the mesh. Water flow through the mesh may also be restricted by water running along the underside of the mesh; although this eventually runs into the guttering after it hits the top outer edge of the guttering, the presence of that water significantly restricts further flow through the mesh.

It is highly desirable that a mesh readily discards any leaf litter and other foreign material which falls onto or is washed onto it. Non discarded material catches other material and also organically breaks down to drop fine material into the guttering. There is room to improve on the performance of existing meshes in this regard.

It has been found from experimentation that water flow is substantially increased if the holes in the mesh are elongated in the direction of water flow across the mesh, that is in the direction running across the width of the guttering, which is in a direction at right angles to the length of the guttering. Also, water flow through the mesh is increased if strands in the mesh aligned in the direction of the guttering are formed to extend below the strands at right angles to them. But this introduces a series of contradictory performance requirements.

In particular, if the mesh strands aligned longitudinally to the guttering project below the general plane of the mesh in order to facilitate water removal on the underside of the mesh, there is the adverse effect that this depth of longitudinal strand increases the longitudinal stiffness of the mesh so that it is difficult to bend along a tight radius during the important tailoring of the mesh to the profile of the roofing material during the installation process. Moulding the mesh from a flexible plastics material would facilitate such bending, but this would be strongly detrimental to the necessary rigidity required for the lateral strands in the mesh which support the span of the mesh between the roof and the outer edge of the guttering. Conventionally a compromise would therefore be required whereby stiffness of the lateral direction would be compromised in order to obtain satisfactory flexibility in the longitudinal direction and flexibility in the longitudinal direction would be compromised in order to achieve sufficient stiffness in the lateral direction.

An object of the present invention is to alleviate the disadvantages of the prior art.

Accordingly, in one aspect the present invention provides a screen applied to overlay a guttering on an outside edge of a roof of a building said screen comprising a panel of generally planar mesh affixed along one edge of the panel to the roof and along the opposite edge of the panel to the top outside edge of the guttering, the mesh being formed of moulded plastics material and comprising:

- a top face and a bottom face on respective opposite sides of the mesh,
- a first array of parallel strands, hereinafter called longitudinal strands, aligned in the direction of said one edge of the panel,
- a second array of parallel strands, hereinafter called lateral strands, integrally moulded with and aligned at right angles to the first array, said first and second arrays of strands defining mesh apertures therebetween extending from said top face to said bottom face, and wherein:

- the thickness of the longitudinal strands extends for substantially the full thickness of the mesh from said top face to said bottom face,
- the thickness of the lateral strands extends along their full length, from said top face to less than 80% of the thickness of the mesh,
- the lateral strands are spaced closer to each other than are the longitudinal strands, and the apertures have an oval shape with their longer axis parallel to the lateral strands.

Preferably the apertures have a longer axis in the range 4.0 to 5.5 mm and a shorter axis in the range 2.5 to 3.0 mm.

Preferably wherein a flat strip portion lies along said one edge of the mesh and parallel to the longitudinal strands, said strip portion being substantially flat on its top face which blends gently with said top face of the remainder of the mesh. Preferably the lateral strands are made from a stiffer material than the longitudinal strands. Preferably the lateral strands are formed from a material having a greater elastic resilience than the material from which the longitudinal strands are made.

Preferably the lateral strands are at least mostly high density polyethylene and the longitudinal strands are at least mostly low density polyethylene and the mesh is formed using a plastics co-extrusion process. More preferably the lateral strands are high density polyethylene and the longitudinal strands are a blend of from 10% to 20% high density polyethylene with the remainder low density polyethylene.

The affixation of the mesh to the guttering may be by screws through the flat strip portion, with or without an overlying metal strip. Alternatively the affixation of the mesh to the guttering may be by means of mated strips of a textile hook and loop fastening system adhered to said flat strip portion and to said top outside edge of the guttering.

In another aspect the invention provides a sheet mesh of plastics material for application upon or above roof guttering to prevent the entry of unwanted materials into the guttering, said mesh comprising:

a first face and a second face on respective opposite sides of the mesh, a first array of parallel strands aligned in a first direction integrally moulded with a second array of parallel strands aligned substantially at right angles to the first array, said strands defining mesh apertures therebetween, the thickness of the strands of the first array extending for substantially the full thickness of the mesh from said first face to said second face, the strands of the second array extending along their full length from said first face to less than 80% of the thickness of the mesh, and the apertures have an oval shape with their longer axis parallel to the lateral strands.

Preferably a flat strip portion lies along an edge of the mesh, said edge extending in the direction of the strands of said first array, said strip portion being substantially flat on said first face which blends gently with said first face of the remainder of the mesh.

Preferably the strands in said first array are spaced closer than the strands of the second array. The apertures through the mesh are preferably of generally elliptical shape which is longitudinally aligned in the direction of the second array.

In a further aspect the invention provides a method of preventing the entry of unwanted materials into a guttering on an outside edge of a roof of a building including affixing a screen over the edge of the roof and the guttering, said screen having a panel of mesh in a generally planar form affixed along one edge of the panel to the roof and along the opposite edge of the panel to the outer face of the guttering, the mesh comprising a top face and a bottom face on respective opposite sides of the mesh, a first array of parallel strands aligned in the direction of said one edge of the panel, a second array of parallel strands integrally moulded with and aligned at right angles to the first array, said strands defining mesh apertures therebetween, the thickness of the strands of the first array extending for the full thickness of the mesh from said top face to said bottom face, and the strands of the second array extending along their full length from said top face to less than 80% of the thickness of the mesh, and

BRIEF DESCRIPTION OF THE DRAWINGS

In order that the invention may be more fully understood there will now be described, by way of example only, preferred embodiments and other elements of the invention with reference to the accompanying drawings where.

DETAILED DESCRIPTION OF THE INVENTION

Figure 1:
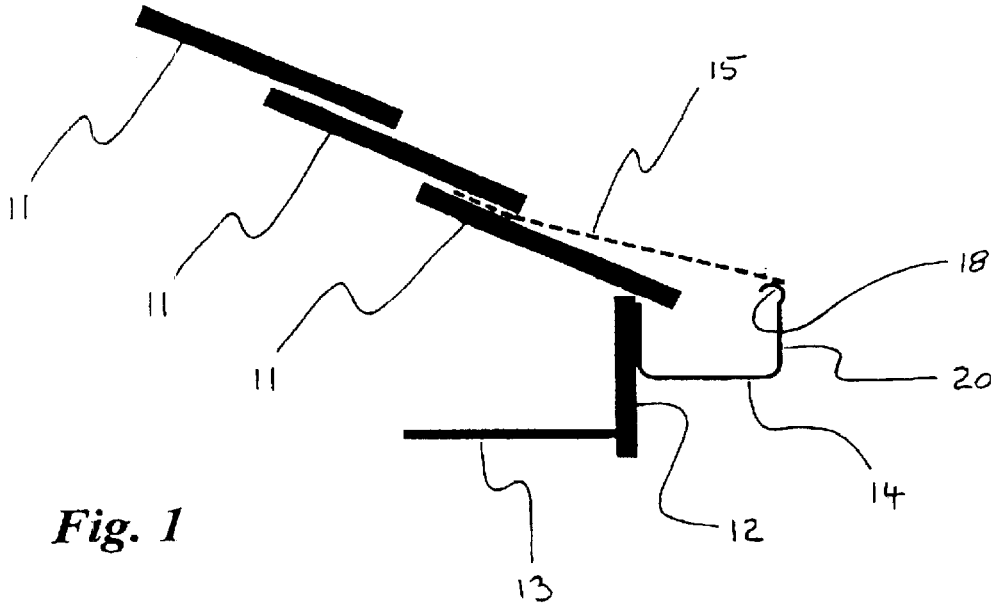
FIG. 1 shows diagrammatically an installation of a mesh to a tiled roof in accordance with an embodiment of the invention.

Referring to the installation shown in FIG. 1, the edge of a roof has roofing tiles 11, fascia 12, soffit 13 and guttering 14. A panel 15 of mesh is fixed over the guttering to prevent the entry of unwanted materials. The panel 15 is formed by unrolling a roll of mesh along the length of the guttering and attaching one edge of the mesh to the roof and the other edge to the guttering. The panel 15 is attached to the roof by the weight of the second bottom row of tiles 11 and to the guttering by means described below with reference to FIG. 6. The lip 18 forms the top outside edge of the guttering and lies at the top of the guttering's outer face 20. The mesh must be flexible enough to easily bend to the profile of the roofing tiles so that the tiles continue to be located by correct engagement with neighbouring tiles.

Figure 2:
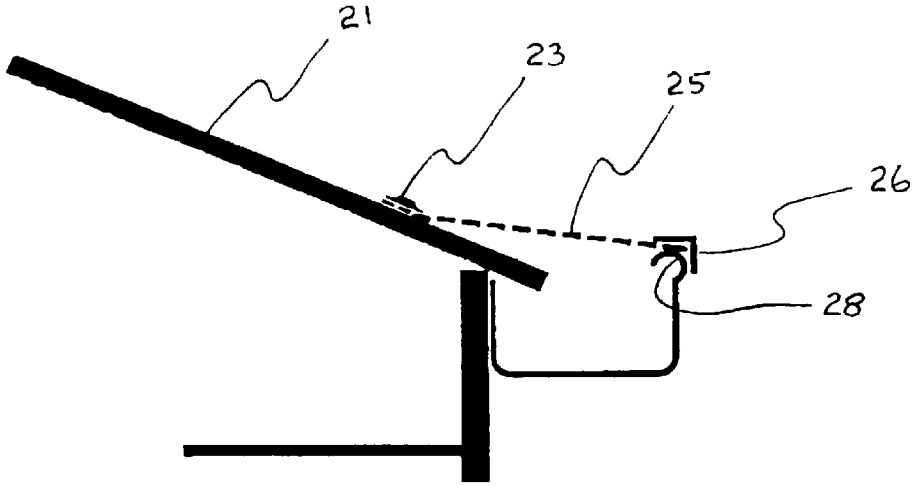
FIG. 2 shows diagrammatically an installation of a mesh to a corrugated steel roof in accordance with another embodiment of the invention.

Referring to FIG. 2, wherein the roof is made from corrugated steel 21, one long edge of the mesh panel 25 is cut and tailored and attached to the roof with appropriate cleats or clips 23 screwed through the mesh onto every alternate corrugation of the roof metal. The opposite long edge of the mesh is attached to the outer lip 28 of the guttering by angle trim 26 which is screwed at intervals to the outer lip 28 of the guttering.

In the case (not shown in the Figures) of a roof with a metal tray or deck cladding, the mesh panel would be cut at each high point of the cladding profile, fixed by cleats screwed to the pan of the profile, and the edges sealed to the roof cladding by means of silicone sealant.

Figure 3:
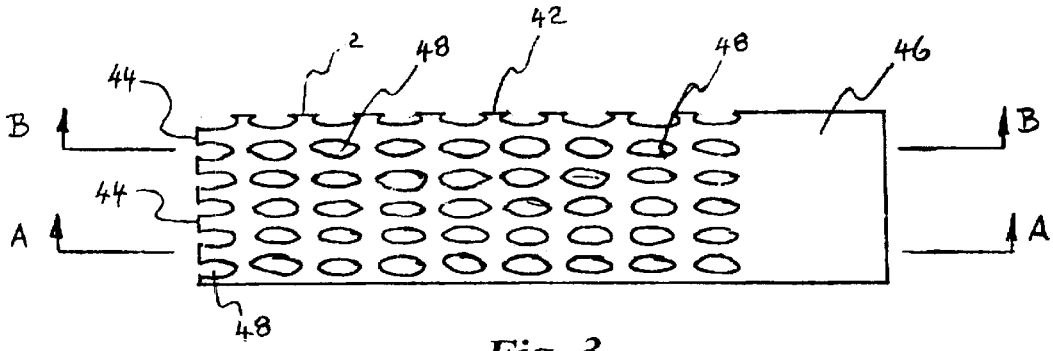
FIG. 3 is a top view of a portion of a mesh in accordance with an embodiment of the invention.
Figure 4:
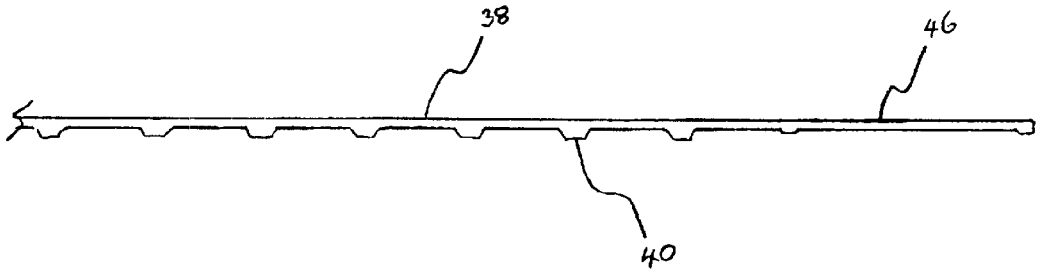
FIG. 4 is a section view of part of the mesh along A—A indicated in FIG. 3.
Figure 5:
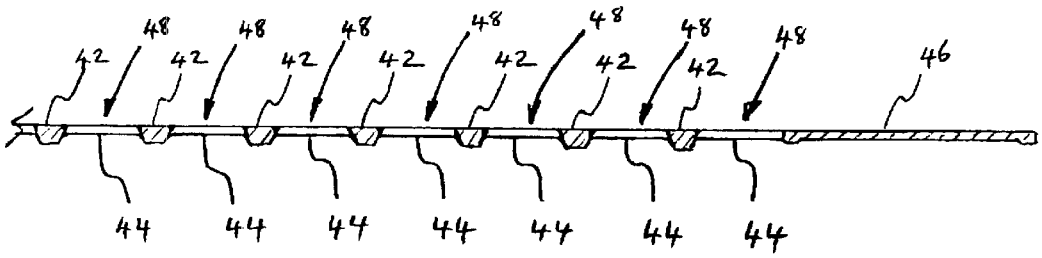
FIG. 5 is a section view of part of the mesh along B—B indicated in FIG. 4.

The mesh 15 as shown in more detail in FIGS. 3 to 5 comprises a particularly preferred embodiment of the present invention. The mesh has the form of a semi-rigid sheet formed from a plastics material (preferably UV stabilised polyethylene) and is provided in a roll of constant width which would preferably be within the range of 25 cm to 100 cm wide depending on the particular application. The mesh as installed has a top face 38 and bottom face 40.

Parallel strands 42 in a first array run longitudinally of the mesh so when it is installed, the strands 42 run in the direction of the length of the guttering 14. Parallel strands 44 in a second array run laterally of the mesh so, when installed, they run in the direction of the width of the guttering. FIG. 4 is cross-section A—A indicated in FIG. 3 and this runs along the centre line of one of the lateral strands 44. FIG. 5 is cross-section B—B indicated in FIG. 3 and this runs along a line halfway between two lateral strands 44. The longitudinal strands 42 extend for the full thickness of the mesh, that is for their full length they occupy the full depth between the top face 38 and bottom face 40. The lateral strands 44 extend from the top face 38 down about halfway to the bottom face. In other embodiments the depth of the lateral strands 44 may be up to 80% of the thickness of the mesh and down to as little as 20% of the thickness. Preferably the depth of the lateral strands is between 30% and 70% of the depth of the longitudinal strands.

Running along the edge of the mesh is a flat strip portion 46. This is approximately 20 mm wide and its thickness is approximately equal to the depth of the lateral strands 44. The top face 38 of the mesh is flat apart from minor irregularities due to non-uniform shrinkage of the plastics material as it solidifies during manufacture. Such shrinkage is somewhat greater at the longitudinal strands due to their greater depth. The strip 46 provides excellent physical reinforcement to the outer edge of the mesh and also provides an excellent location site for the means by which the mesh is affixed to the lip 18 of the guttering. Preferably the flat strip portion 46 is not perforated.

The longitudinal strands 42 have a generally trapezoidal cross-section as best seen in FIG. 5 while the lateral strands 44 have a generally semi-circular cross-section. Where the strands 42 and 44 intersect, that intersection is heavily gusseted in the plane of the mesh thus rounding off the corners of the holes. The apertures 48 in the mesh are accordingly of a generally elliptical or oval shape and their longer axis is aligned in the direction of the lateral strands. The gusseting provides a substantial strengthening feature to the mesh which greatly increases its resistance to tearing and/or splitting. The oval shaped aperture, with its alignment in the direction of water flow, increases water transmission through the mesh when compared with apertures aligned other ways (such as those in the prior art documents cited above) and reduces the incidence of entry of pine needles and the finer leaf matter which causes problems with prior art meshes uses for this purpose.

Typical dimensions for the mesh are:

| | |
|---|---|
| centre to centre spacing of longitudinal strands 42 | 7.0 to 8.5 mm and preferably 7.5 mm |
| centre to centre spacing of lateral strands 44 | 4.5 to 5.5 mm and preferably 5.0 mm |
| depth of longitudinal strands 42 | 2 mm |
| depth of lateral strands and flat strip portion | 1 mm |
| major axis of apertures 48 | 4.0 to 5.5 mm |
| minor axis of apertures 48 | 2.5 to 3.0 mm |

The smooth top face 38 on the mesh is particularly advantageous. It should be appreciated that the whole of the surface that can be seen in FIG. 3 is substantially flat. The smoothness of the top face provides outstanding "slip-off" of debris. Experiments have indicated that a 60% improvement in "slip-off" of pine needles is achieved by this mesh compared with a corresponding mesh where the strands form a rippled top surface. Any deviation from flatness (for example that caused by differential shrinkage during manufacture) is preferably kept to less than 0.25 mm.

The ridged bottom face 40 on the mesh provides a substantial advantage in that the water flow down the underside of the mesh is substantially disturbed from a smooth flow and each longitudinal strand 42 provides a break-off point for the water flow.

A suitable material for the mesh is a high density polyethylene with conventional UV stabilizing additives. Preferably however the mesh is produced by a co-extrusion process whereby the second array (lateral strands 44) is moulded from a more flexible material than the first array of strands. A particularly desirable combination of materials is for the shallower strands (ie those running across the width of the guttering) to be moulded from high density polyethylene (HDPE) while the strands extending in the direction of the gutter are moulded from low density polyethylene (LDPE) in a co-extrusion process. By this means the mesh may be made stiffer in the lateral direction than in the longitudinal direction, despite the strands in the longitudinal direction having a deeper profile. The mesh thus has an improved resistance to sagging into the guttering.

HDPE has a greater elastic resilience than LDPE. HDPE thus tends more to spring back to its originally moulded position whereas LDPE tends to more readily retain the shape to which it is bent during tailoring of the mesh to suit the profile of the roof to which it is installed. In localities with a high fire danger, the mesh material preferably has a self-extinguishing fire retardant characteristic which desirably conforms to a fire rating of 3 under Australian Standard AS1530 Part 2.

In order to improve bonding of the two types of polyethylene, a small proportion of LDPE may be blended with the HDPE and/or a small proportion of HDPE may be blended with the LDPE.

It will be understood that the present invention does not encompass the use of a mesh with a woven structure, namely one with the strands alternately passing from one side of the mesh to the other.

Figure 6:
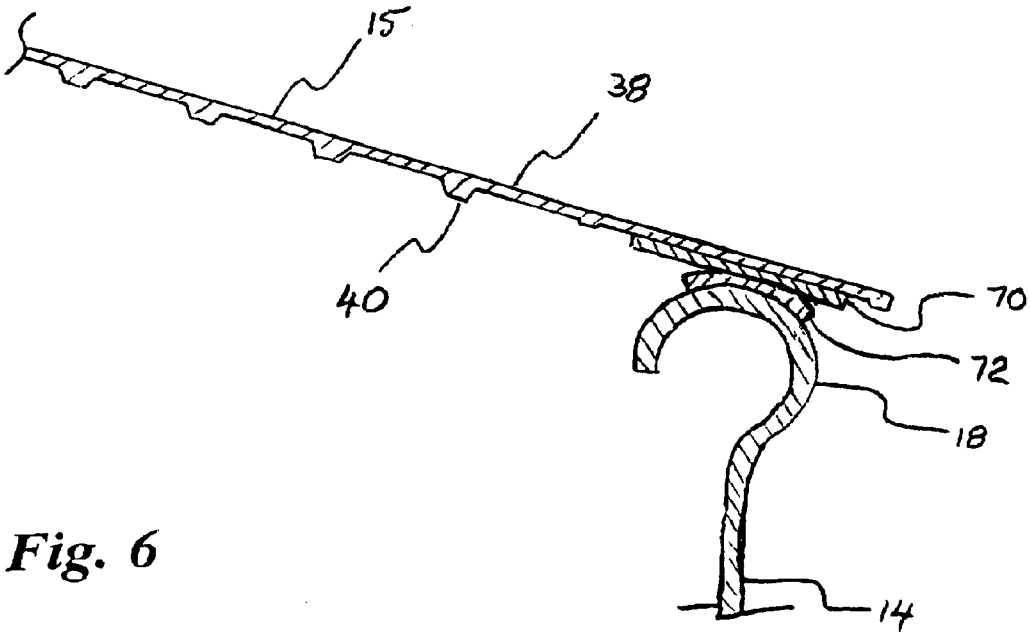
FIG. 6 shows an enlarged view of portion of FIG. 1.

Referring to FIG. 6, where the outer edge of the panel 15 of mesh reaches the outer lip 18 of the guttering 14 no angle trim or screws are employed to fix the mesh to the guttering. Instead the embodiment employs a mating pair of strips 70 and 72 of a textile hook and loop fastening system, an example of which is marketed under the trade mark Velcro. The strips 72 and 70 are held by adhesive to the top of the guttering lip 18 and to the underside of the strip portion 46 respectively. The strip 32 which has the hooks is adhered to the guttering and the strip 30 having the loops is adhered to the mesh. The strips 72 and 70 are run continuously along the guttering and the mesh. The inner or roof side edge of the mesh is first securely affixed to the roof in the conventional manner and the mesh is then tensioned across the guttering and pressed down to contact the mating strips 72 and 70 of hook and loop textile. Such affixing system for the mesh overcomes many longstanding limitations of guttering protection systems. The mesh may be successfully fitted to brittle plastic guttering without damaging them; its tension may be adjusted by small increments; when used on all types of guttering the mesh is much less prone to damage due to point loading from screws, or thermal expansion of the roof and/or guttering; and much easier access is provided into the guttering for sludge cleaning procedures.

In contrast to the mesh-to-gutter fixing system described above with reference to FIG. 6, the fixing system indicated in FIG. 2 is more conventional but less preferred. The mesh panel 25 is attached to the guttering by clamping the outer edge of the mesh between the guttering and a length of angle trim 16 which is screwed at intervals to the outer lip 18 of the guttering.

Use of the "hook and loop" fastening system described above with reference to FIG. 6 offers the following advantages when compared with the alternative fastening system shown in FIG. 2:

(i) there is no longer the problem with using screws to fasten mesh to the guttering, in that they are very difficult to correctly tighten if the guttering is made of plastics material more than 3 to 5 years old due to embrittlement of such plastic;

(ii) the mesh is not subjected to the same point loads from screws passing through the mesh which then tears near the screws;

(iii) the mesh is easier to tension more evenly;

(iv) when sludge builds up in the guttering, its removal is made easier by the easier access provided by the hook and loop fastening system;

(v) if the mesh sags due to accidental pressure on it (by stepping on it for example) or from traffic by animals, its readjustment is easier; and (vi) the less rigid fixing may result in substantially lower tensions being induced in the mesh due to thermal expansion of the roof and guttering.

Those skilled in the art will appreciate that the invention described herein is susceptible to variations and modifications other than those specifically described. It is to be understood that the invention includes all such variations and modifications which fall within its spirit and scope.

What is claimed is:

1. A screen applied to overlay a guttering on an outside edge of a roof of a building, the screen comprising:

a panel of generally planar mesh affixed along one edge to the roof and along an opposite edge to a top outside edge of the guttering, said mesh being formed of plastic and comprising a top face and a bottom face on respective opposite sides, a first array of parallel strands defining longitudinal strands aligned in the direction of the one edge of the panel, a second array of parallel strands defining lateral strands integrally molded with and aligned at right angles to the first array, said first and second arrays of strands defining mesh apertures therebetween extending from said top face to said bottom face, a thickness of the longitudinal strands extending for substantially a full thickness of the mesh from said top face to said bottom face, a thickness of the lateral strands extending along their full length, from said top face to less than 80% of the thickness of the mesh, said lateral strands being spaced closer to each other than said longitudinal strands, and the mesh apertures having an oval shape with their longer axis parallel to said lateral strands.

2. A screen according to claim 1 wherein said panel further comprises a flat strip portion lying along the one edge of the mesh and parallel to said longitudinal strands, and wherein said strip portion is substantially flat on its top face which blends gently with said top face of a remainder of the mesh.

3. A screen according to claim 1 wherein the mesh apertures have a longer axis in the range 4.0 to 5.5 mm and a shorter axis in the range 2.5 to 3.0 mm.

4. A screen according to claim 3 wherein said panel further comprises a flat strip portion lying along the one edge of the mesh and parallel to said longitudinal strands, and wherein said strip portion is substantially flat on its top face which blends gently with said top face of a remainder of the mesh.

5. A screen according to claim 1 wherein said lateral strands are stiffer than said longitudinal strands.

6. A screen according to claim 1 wherein said lateral strands have greater elastic resilience than said longitudinal strands.

7. A screen according to claim 6 wherein said lateral strands comprise high density polyethylene and said longitudinal strands comprise low density polyethylene.

8. A screen according to claim 7 wherein said lateral strands comprise high density polyethylene and said longitudinal strands comprise a blend of from 10% to 20% high density polyethylene with a remainder low density polyethylene.

9. A screen according to claim 1 further comprising mating strips of a textile hook and loop fastening system for adhering said panel to the guttering.

10. A screen applied to overlay a guttering on an outside edge of a roof of a building, the screen comprising:

a panel of generally planar mesh affixed along one edge to the roof and along an opposite edge to a top outside edge of the guttering, said mesh being formed of plastic and comprising a top face and a bottom face on respective opposite sides, a first array of parallel strands defining longitudinal strands aligned in the direction of the one edge of the panel, a second array of parallel strands defining lateral strands aligned at right angles to the first array, said first and second arrays of strands defining mesh apertures therebetween extending from said top face to said bottom face, said lateral strands being spaced closer to each other than said longitudinal strands, and the mesh apertures having an oval shape with their longer axis parallel to said lateral strands.

11. A screen according to claim 10 wherein said panel further comprises a flat strip portion lying along the one edge of the mesh and parallel to said longitudinal strands, and wherein said strip portion is substantially flat on its top face which blends gently with said top face of a remainder of the mesh.

12. A screen according to claim 10 wherein the mesh apertures have a longer axis in the range 4.0 to 5.5 mm and a shorter axis in the range 2.5 to 3.0 mm.

13. A screen according to claim 12 wherein said panel further comprises a flat strip portion lying along the one edge of the mesh and parallel to said longitudinal strands, and wherein said strip portion is substantially flat on its top face which blends gently with said top face of a remainder of the mesh.

14. A screen according to claim 10 wherein said lateral strands are stiffer than said longitudinal strands.

15. A screen according to claim 10 wherein said lateral strands have greater elastic resilience than said longitudinal strands.

16. A screen according to claim 15 wherein said lateral strands comprise high density polyethylene and said longitudinal strands comprise low density polyethylene.

17. A screen according to claim 16 wherein said lateral strands comprise high density polyethylene and said longitudinal strands comprise a blend of from 10% to 20% high density polyethylene with a remainder low density polyethylene.

18. A screen according to claim 10 further comprising mating strips of a textile hook and loop fastening system for adhering said panel to the guttering.

* * * * *